US006592434B1

(12) United States Patent
Vanell et al.

(10) Patent No.: US 6,592,434 B1
(45) Date of Patent: Jul. 15, 2003

(54) WAFER CARRIER AND METHOD OF MATERIAL REMOVAL FROM A SEMICONDUCTOR WAFER

(75) Inventors: James F. Vanell, Tempe, AZ (US); James A. Grootegoed, Chandler, AZ (US); Laura John, Chandler, AZ (US)

(73) Assignee: Motorola, Inc., Schaumburg ( * ) Notice: Subject to any disclaimer, the term of this patent is extended or adjusted under 35 U.S.C. 154(b) by 134 days.

(21) Appl. No.: 09/714,523

(22) Filed: Nov. 16, 2000

(51) Int. Cl.[7] ..... B24B 29/00
(52) U.S. Cl. ..... 451/41; 451/288
(58) Field of Search ..... 451/41, 283, 285, 451/286, 287, 288, 289, 291, 292, 366

(56) References Cited

U.S. PATENT DOCUMENTS 5,938,884 A * 8/1999 Hoshizaki et al. ..... 156/345.14
5,951,373 A * 9/1999 Shendon et al. ..... 451/41
6,030,275 A * 2/2000 Lofaro ..... 451/5
6,083,089 A * 7/2000 Breivogel et al. ..... 451/287
6,168,504 B1 1/2001 Gotcher
6,203,408 B1 * 3/2001 Quek ..... 451/41

FOREIGN PATENT DOCUMENTS

EP 0558787 A1 9/1993
WO WO 01/72472 A2 10/2001

* cited by examiner

*Primary Examiner*—Joseph J. Hall, III
*Assistant Examiner*—David B. Thomas
(74) *Attorney, Agent, or Firm*—Lanny L. Parker; Robert A. Rodriguez; Joseph P. Lally

(57) ABSTRACT

A wafer carrier (300) for a CMP tool is adjustable to provide center fast to edge fast material removal from a semiconductor wafer. The wafer carrier (300) holds the semiconductor wafer without vacuum. The semiconductor wafer is held by a carrier ring (308). An elastically flexed wafer support structure (318) is a support surface for the semiconductor wafer. Elastically flexed wafer support structure (318) can be bowed outward or bowed inward in an infinite number of different contours. The semiconductor wafer conforms to the contour of the elastically flexed wafer support structure (318) when a down force is applied to the wafer carrier (300) during a polishing process. Changing the contour is used to produce different material removal rates across the radius of the semiconductor wafer to increase wafer planarity in a polishing process.

23 Claims, 2 Drawing Sheets

WAFER CARRIER AND METHOD OF MATERIAL REMOVAL FROM A SEMICONDUCTOR WAFER

BACKGROUND OF THE INVENTION

The present invention relates, in general, to chemical mechanical planarization (CMP) tools, and more particularly, to a wafer carrier.

Chemical mechanical planarization (also referred to as chemical mechanical polishing) is a proven process in the manufacture of advanced integrated circuits. CMP is used in almost all stages of semiconductor device fabrication. For example, chemical mechanical planarization allows the creation of finer structures via local planarization and for global wafer planarization to produce high density vias and interconnect layers. Materials that undergo CMP in an integrated circuit manufacturing process include single and polycrystalline silicon, oxides, nitrides, polyimides, aluminum, tungsten, and copper.

In general, the planarity of the starting wafer worsens during manufacturing processes such as material removal steps and various deposition steps. Typically, during the chemical mechanical planarization process, material is removed from the edge of the semiconductor wafer at a rate that is different from the removal rate at the center due to slurry transport effects. This phenomenon, as well as several others including clamp ring marks, can result in edge exclusion. Edge exclusion can significantly reduce yields by rendering die near the edges of a semiconductor wafer unusable. The edge die can make up a large percentage of the overall die on a semiconductor wafer due to the large annular area involved. The yield impact increases as the industry moves to the next generation 300 millimeter diameter semiconductor wafers.

One factor affecting the rate of material removal is the movement of new slurry added to the surface of the wafer and the removal of spent slurry. The slurry transport varies across the semiconductor wafer from the edge to center. More specifically, slurry is removed and replaced at a slower rate at the center of the semiconductor wafer than at the edge. An example of how non-planarity can affect performance of a semiconductor device is illustrated in a copper CMP process. A non-planar die surface in an after-copper polish step results in non-uniform copper interconnect thickness. The non-uniformity of the copper interconnect corresponds to variation in resistance of the interconnect that will directly impact chip performance. In many cases, interconnect delay has become more significant than device delay in the performance of a chip such as a microprocessor.

Accordingly, it would be advantageous to have a chemical mechanical planarization tool that can compensate for different planarization or removal rates in different locations on a semiconductor wafer. More specifically, compensating for different planarization or removal rates will provide increased planarity and uniform material removal rate across a semiconductor wafer. In the limit, the CMP tool and process could be used to reengineer wafers that are out of specification for planarity due, for example, to wafer fabrication tolerances or deposition process variations, through a replanarization process mapped to compensate for the variation in thickness across the out of specification wafer.

DETAILED DESCRIPTION OF THE DRAWINGS

Figure 1:
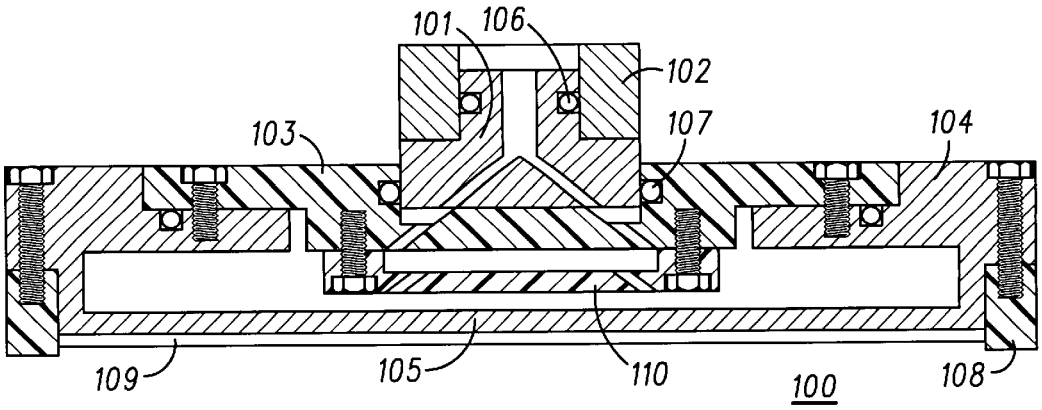
FIG. 1 is cross-sectional view of a wafer carrier capable of applying variable pressure across the surface of a semiconductor wafer.

In general, Chemical Mechanical Planarization (CMP) is used to remove material on a semiconductor wafer to achieve planarity. Ideally, a uniform amount of material is removed across the semiconductor wafer leaving a highly planar surface on which to continue wafer processing. Any non-uniformity in the polishing process may result in a loss of yield or long term device reliability problems. Uniformity is the measure of variation in surface height across a semiconductor wafer. Some common types of chemical mechanical planarization processes in the semiconductor industry are used to remove, for example, oxides, polysilicon and metals such as tungsten and copper.

Chemical mechanical planarization tools currently used in the semiconductor industry are capable of achieving wafer uniformity in the range of 6–12 percent. This level of uniformity is sufficient for building devices having critical dimensions in the range of 0.35–0.18 microns. In the future, polishing uniformity in the range of 1–3 percent will be required as the semiconductor industry moves towards building devices having critical dimensions in the range of 0.10 microns and below. Using current techniques, the planarization problem will be further exacerbated as the semiconductor wafer is increased in diameter from 200 millimeters to 300 millimeters.

A CMP process for a semiconductor wafer is achieved using a polishing chemistry or polishing slurry that chemically and abrasively removes material from the semiconductor wafer. The chemicals and abrasives in a slurry vary depending on the types of materials being removed from an integrated circuit. Polishing slurries for planarizing an oxide layer differ significantly from a slurry used to planarize copper interconnects.

A common factor in all CMP processes used in the semiconductor industry is the mechanical aspects of the procedure. In general, a semiconductor wafer has a processed side and an unprocessed side. The processed side of the semiconductor wafer has a surface that includes devices and interconnects. The unprocessed side, or the backside of the semiconductor wafer, may or may not have processing steps performed thereon. During a CMP process, a wafer carrier exposing the processed side of the semiconductor wafer for material removal holds the semiconductor wafer.

The wafer carrier includes a support surface against which the unprocessed side of the semiconductor wafer rests.

A second support surface is required to abrade the exposed surface of the semiconductor wafer. For example, a platen is a well known second support surface that is used on many chemical mechanical planarization tools today. A polishing media placed on the platen aids in the material removal process. The polishing media provides for the transport of the polishing slurry. Typically, the polishing media is a compliant polyurethane pad having patterned grooves, channels, or holes that allow the polishing slurry to flow into and out of all areas of the semiconductor wafer surface being planarized. In general, the wafer carrier, the platen, or both are rotating during the CMP process. The wafer carrier holding the semiconductor wafer is brought to the platen with the exposed surface of the wafer coplanar with the surface of the polishing media. A pressure applied to the semiconductor wafer promotes the abrasive removal of material from the wafer.

Although the mechanical aspects of the CMP process sound simple in principle, achieving the planarity required in the manufacture of semiconductor devices is extremely difficult. The current state of the art, in the field of chemical mechanical planarization, is not adequate for smaller critical dimensions or larger wafer sizes. In fact, every mechanical element in a CMP tool is suspect in contributing to the overall planarity problems facing the semiconductor industry. A first problem occurs due to the fact that a wafer carrier cannot maintain the exposed surface of the semiconductor wafer coplanar with the polishing media. A second problem is controlling the pressure exerted on the wafer to be evenly distributed across the exposed surface of the semiconductor wafer. A third problem is wafer movement that results from the semiconductor wafer not being rigidly held during the CMP process. Excessive movement of the semiconductor wafer produces uneven material removal and variation in the overall material removal rate. Fourth, the polishing media does not provide for the adequate transport of polishing slurry. Polishing slurry is renewed at the perimeter of the semiconductor wafer at a faster rate than at the center of the semiconductor wafer. It is well known that newer polishing slurry will remove material at a faster rate than old used polishing slurry. Fifth, temperature differences due to friction and variations in heat loss due to convection, conduction and, to a smaller extent, to radiation produce different rates of chemical reaction. The temperature varies from the perimeter to the center of the semiconductor wafer thereby producing different rates of material removal. Finally, the mechanical set up changes over time. For example, the platen or polishing media wears as more semiconductor wafers are processed, providing an uneven or non-planar support surface that results in variations of the material removal rates across the semiconductor wafer. Each of these problems must be understood and addressed if CMP processes are to be employed in a semiconductor manufacturing environment in the future.

There are many different strategies being employed by CMP tool manufacturers to address the problems listed hereinabove. One type of wafer carrier has a support surface that is machined to a predetermined curvature. The fixed curvature profile is designed to compensate for edge fast material removal (convex shape). A fixed curvature profile does not allow for real time process control of film removal uniformity. This is especially problematic if consumables and prior process results (film deposition uniformity) vary. The curvature of the wafer carrier is a compromise at best and manufacturers are abandoning fixed curved surfaces on the wafer carrier support surface in lieu of a flat surface.

In general, the support surface of a wafer carrier has a large number of holes for providing gas or vacuum. Vacuum is used to hold the semiconductor wafer to the support surface while the wafer is in transport from one position to another. The vacuum is released after the semiconductor wafer is brought coplanar to the surface of the polishing media and the polishing process has begun. A carrier ring on the wafer carrier keeps the semiconductor wafer from sliding off the support surface.

Pressure is applied to the semiconductor wafer by forcing a gas, such as nitrogen, through the openings on the support surface. The gas pushes against the back surface of the semiconductor wafer thereby applying a pressure that presses the exposed surface of the semiconductor wafer against the polishing media during a material removal process. In theory, the gas is supposed to provide even pressure across the backside of the semiconductor wafer. The magnitude of the gas pressure can be varied to control the pressure applied to the semiconductor wafer. However, using gas to provide pressure on the back surface of the semiconductor wafer is unreliable, uncontrollable, and unrepeatable from wafer to wafer. Moreover, the wafer carrier is prone to damage, has pneumatic control problems, and poses a contamination risk due to particulates from chemical aspiration.

Another wafer carrier that currently is in production for a CMP tool has an extremely complex design for providing angular compliance and equal pressure across the entire surface of the semiconductor wafer. A first element of the wafer carrier is an inflatable bellows mechanism that is designed to maintain coplanarity between the semiconductor wafer surface and the polishing media. A second element of the wafer carrier is an elastomeric bladder that can be inflated or deflated to control the pressure applied to the backside of a semiconductor wafer. The elastomeric bladder is placed over a support structure of the wafer carrier and openings on a support surface provide either a vacuum or gas. The vacuum applied through the openings holds the semiconductor wafer to the support surface. The gas applied forces the wafer against the platen. A carrier ring on the support surface retains the semiconductor wafer during a material removal process. The negative or positive pressure applied through the support structure to the elastomeric bladder (non-rigid) applies pressure to the backside of the wafer.

The pressure in the elastomeric bladder is set at a nominal value that is a function of the CMP process being used. The wafer carrier is moved into place such that an exposed surface of the semiconductor wafer is coplanar to the surface of the polishing media. The pressure in the elastomeric bladder is increased until the desired pressure for the material removal process is achieved. No pressure profiling is possible with this system. Increasing or decreasing the pressure in the elastomeric bladder only changes the rate at which material is removed but does nothing to compensate for the different rates of material removal across the radius of the semiconductor wafer. Other factors that impact use of the wafer carrier in a production environment are the risk of bladder rupture, extrusion from under the wafer carrier, and failures due to torque. The cost and difficulty in repairing this type of wafer carrier is also a factor. Moreover, issues such as uniformity of material removal and increased mechanical loading on the wafer carrier will have to be addressed for it to have applicability for 300 millimeter (diameter) semiconductor wafers.

FIG. 1 is a cross-sectional view of a wafer carrier 100 capable of applying variable pressure across a surface of a semiconductor wafer. Variable pressure is achieved by actively changing a contour of a support surface of wafer carrier 100. Wafer carrier 100 includes a first section having a primary function of maintaining the support surface substantially planar to a surface of a polishing media. The act of maintaining wafer carrier 100 substantially coplanar to the polishing media surface is known as providing angular compliance. Wafer carrier 100 also has a second section for holding and supporting the semiconductor wafer. The second section holds the semiconductor wafer such that a surface of the semiconductor wafer is exposed for material removal. The description hereinabove is not meant to imply that the first and second sections must be separate elements of wafer carrier 100 but that any wafer carrier used for chemical mechanical planarization will have both elements either combined or separate within the structure.

Wafer carrier 100 comprises a carrier button 101, a drive shaft 102, a carrier cover 103, a carrier plate 104, a flexible wafer support structure 105, an o-ring 106, an o-ring 107, a carrier ring 108, a carrier film 109, and a gas supply hat section 110. In one embodiment of wafer carrier 100, drive shaft 102 is hollow, allowing the transport of fluids and gases to or from a chamber within wafer carrier 100. Drive shaft 102 connects to a motor (not shown) that rotates wafer carrier 100. A shaft on carrier button 101 fits into the opening of drive shaft 102. The shaft of carrier button 101 is grooved to receive o-ring 106. O-ring 106 provides a pressure seal such that gas or fluid cannot escape between drive shaft 102 and the shaft of carrier button 101. Carrier button 101 includes passageways to provide a gas within wafer carrier 100. The cylindrical portion of carrier button 101 that extends outside of drive shaft 102 ends in the shape of a curved dome, providing for angular compliance.

Carrier cover 103 is a cover plate of wafer carrier 100 that includes an opening for receiving carrier button 101. and a contact surface for the curved dome of carrier button 101. The opening in carrier cover 103 is approximately the diameter of the cylindrical portion of carrier button 101. The contact surface of carrier cover 103 is inset into the opening in carrier cover 103. Carrier button 101 is placed through the opening in carrier cover 103 until the domed surface of carrier button 101 touches the contact surface of carrier cover 103. The wall of carrier button 101 is grooved for receiving o-ring 107. O-ring 107 contacts the cylindrical portion of carrier button 101 and carrier cover 103 thereby forming a pressure seal that prevents gas from escaping or entering, yet allowing carrier button 101 to move in relation to carrier cover 103. Openings are formed through carrier cover 103 to provide gas or vacuum.

In an embodiment of wafer carrier 100, the contact surface of carrier cover 103 is substantially parallel to the surface of the semiconductor wafer. Angular compliance is achieved by the contact surface of carrier cover 103 rolling across the curved dome of carrier button 101 to reposition the exposed surface of the semiconductor wafer coplanar to the surface of the polishing media as pressure is applied to wafer carrier 100. The curved surface changes the angular relationship between drive shaft 102 (vertical direction) and the contact surface of carrier cover 103.

Gas supply hat section 110 is a structure for strengthening the contact surface of carrier cover 103. Gas supply hat section 110 makes the contact surface of carrier cover 103 rigid (will not flex). Gas supply hat section 110 lies beneath carrier cover 103 and has an area that extends beyond the contact surface of carrier cover 103. Gas supply hat section 110 is connected rigidly via screws to carrier cover 103. It should be noted that making the contact surface of carrier cover 103 rigid eliminates the need for gas supply hat section 110. Future designs will eliminate this feature. Gas supply hat section 110 has openings for providing gas or vacuum to or from an interior region of wafer carrier 100.

Carrier plate 104 completes a sealed housing for wafer carrier 100. Carrier plate 104 comprises an upper support structure, a sidewall, and flexible wafer support structure 105. In an embodiment of wafer carrier 100, carrier plate 104 is machined or molded as a single structure.

Typically, carrier cover 103, gas supply hat section 110, and carrier plate 104 would be manufactured from a mechanically-strong, corrosion-resistant material such as 17-4 PH stainless steel in a hardened condition such as H900. The carrier plate 104 may also be fabricated from various materials that allow a tailored mechanical strength and resulting strain profile when stresses are applied, especially to flexible wafer support structure 105. These various materials include, among others, 316 stainless steel, C22 Carpenter steel, 304 stainless steel, and nitinol, a shape memory alloy.

The upper support structure of carrier plate 104 connects to carrier cover 103 and forms a sealed cavity within wafer carrier 100. Carrier cover 103 is bolted to the upper support structure of carrier plate 104. A groove is formed in the upper support structure that receives an o-ring to form a pressure seal as carrier cover 103 and carrier plate 104 are bolted together.

Flexible wafer support structure 105 of carrier plate 104 supports a semiconductor wafer during a chemical mechanical planarization process. Carrier film 109 is placed on flexible wafer support structure 105. Carrier film 109 is a compliant film that holds the semiconductor wafer in place during the chemical mechanical planarization process.

Carrier ring 108 retains the semiconductor wafer from leaving wafer carrier 100 during the chemical mechanical planarization process. Carrier ring 108 is placed around the periphery of carrier plate 104 and extends slightly past the surface of carrier film 109 to catch the edge of the semiconductor wafer being planarized. In an embodiment of wafer carrier 100, carrier ring 108 is fitted and supported within a recess formed in the sidewall of carrier plate 104. Placing carrier ring 108 within the recess assists bolts placed vertically through carrier plate 104 to securely hold carrier ring 108.

As mentioned hereinabove, one of the main problems facing the chemical mechanical planarization process is the different rates of material removal across the radius of the semiconductor wafer. Wafer carrier 100 is designed to allow the contour of flexible wafer support structure 105 to change in order to compensate for different material removal rates across the wafer radius. The change in contour of the surface of flexible wafer support structure 105 is achieved by providing pressure (via gas or fluid or vacuum) into the cavity within wafer carrier 100. Flexible wafer support structure 105 comprises a thin flexible material that is deformable by vacuum or pressure introduced in the cavity of wafer carrier 100. The sidewall and upper support structure of carrier plate 104, as well as carrier cover 103, are structurally rigid and not affected by vacuum or pressure introduced into the cavity of wafer carrier 100.

In one embodiment of wafer carrier 100, flexible wafer support structure 105 is made from stainless steel. The thickness of flexible wafer support structure 105 ranges from approximately 0.01 to 0.6 centimeters and is highly dependent on material type and application. Under quiescent conditions (normal room pressure) flexible wafer support structure 105 has a first contour, for example a flat surface. During a chemical mechanical planarization process (including prior to starting the material removal process) flexible wafer support structure 105 changes from the first contour to a second contour to compensate for different material removal rates across the radius of the semiconductor wafer. The second contour causes a non-uniform pressure along the radius of the semiconductor wafer that is biased for increased material towards the center of the wafer or the edge of the wafer.

Providing a vacuum into the sealed cavity (or removing a fluid) of wafer carrier 100 pulls flexible wafer support structure 105 inward such that the outer edge of the surface of flexible wafer support structure 105 is lower (bowed inward) than the center of the surface of the flexible wafer support structure 105. The surface of flexible wafer support structure 105 under vacuum is best described as being somewhat concave although the rate of change and type of change on wafer support structure 105 is material dependent. In this state, material is removed at a more rapid rate at the edge of the semiconductor wafer than at the center.

It should be noted that under vacuum or pressure, the surface of flexible wafer support structure 105 is semi-rigid. Downward pressure applied to wafer carrier 100 forces the semiconductor wafer to conform to the shape of the surface of flexible wafer support structure 105. In other words, in a final state or contour the surface of flexible wafer support structure 105 is semi-rigid (making the semiconductor wafer conform to the contour) and does not significantly change shape as pressure is applied during the material removal process. Bowing flexible wafer support structure 105 inward (concave) is also used to hold the semiconductor wafer to wafer carrier 100 during transport.

Providing a gas (or fluid) to pressurize the sealed cavity of wafer carrier 100 pushes flexible wafer support structure 105 outward such that the center of the surface of flexible wafer support structure 105 is lower (bowed outward) than the outer edge of the surface of the flexible wafer support structure 105. The surface of flexible wafer support structure 105 under pressure is best described as being somewhat convex although the rate of change and type of change on wafer support structure 105 is material dependent. In this state, material would be removed at a more rapid pace at the center of the semiconductor wafer than at the edge.

The rate of change in the contour of wafer support structure 105 is directly related to the amount of vacuum or pressure being applied to wafer carrier 100. For example, increasing vacuum in the sealed cavity of wafer carrier 100 increases material removal near the edge of the semiconductor wafer in relation to the center of the semiconductor wafer. Conversely, increasing the pressure in the sealed cavity of wafer carrier 100 increases material removal near the center of the semiconductor wafer in relation to the edge of the semiconductor wafer. A recipe of using both edge fast and center fast contours of flexible wafer support structure 105 could be used to maximize wafer planarity based on modeling information on the particular CMP process. Moreover, the ability to alter the wear rate at specific points across the semiconductor wafer surface allows a semiconductor manufacturer to bring out-of-specification semiconductor wafers (due to planarity) back into specification which would greatly reduce material scrap rates. In addition, edge losses would be significantly reduced.

Figure 2:
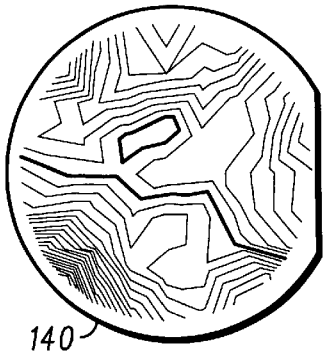
FIG. 2 is a topographic view of a typical semiconductor wafer.

FIG. 2 is a topographic view of a semiconductor wafer 140. The lines illustrate changes in surface height across semiconductor wafer 140 following a standard CMP process as found in the prior art. Note the various thickness displayed, the random pattern of the thickness variations and the generally edge-fast rate of material removal.

Figure 3:
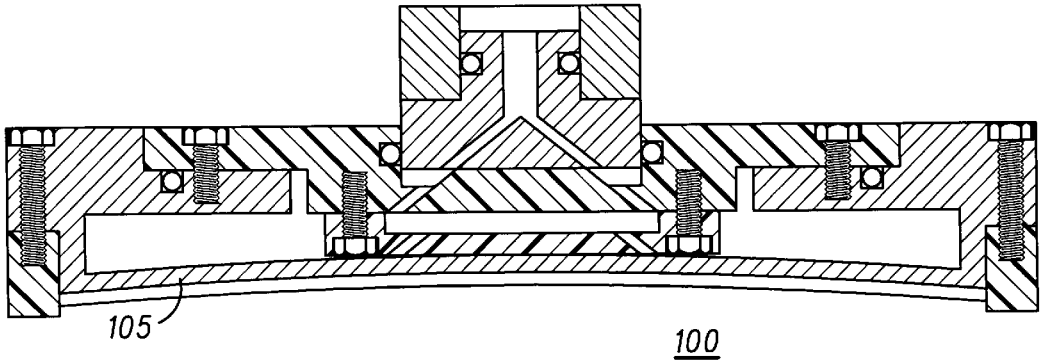
FIG. 3 is an illustration of the wafer carrier of FIG. 1 having the flexible wafer support structure in a bowed inward state.

FIG. 3 is an illustration of the wafer carrier of FIG. 1 having the flexible wafer support structure 105 in a bowed inward state.

Figure 4:
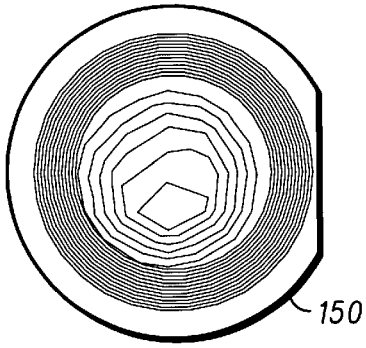
FIG. 4 is a topographic view of a semiconductor wafer polished using the wafer carrier of FIG. 1 in a bowed inward state.

FIG. 4 is a topographic view of a semiconductor wafer 150 polished using wafer carrier 100 of FIG. 1 in the bowed inward state as illustrated in FIG. 3. The downward force applied to semiconductor wafer 150 to conform to the surface contour (convex) of wafer carrier 100 of FIG. 1 is 4.5 pounds per square inch (psi). A pressure within the sealed cavity of wafer carrier 100 of FIG. 1 during the chemical mechanical planarization process was set at 0.1 psi. The lack of pressure within the sealed cavity allows the down force to cause the lowermost surface of the carrier to become concave as the metal surface is deflected away from the resultant force against the wafer. Since the area along the edges of the lowermost surface of wafer carrier 100 are supported by the carrier sidewalls, this annular area provides strain resistance and allows higher pressure on the wafer surface immediately below. The closely spaced lines at the periphery of semiconductor wafer 150 show a higher rate of material removal at the edge of semiconductor wafer 150 than at the center, as expected with a concave surface contour for wafer carrier 100 of FIG. 1.

Figure 5:
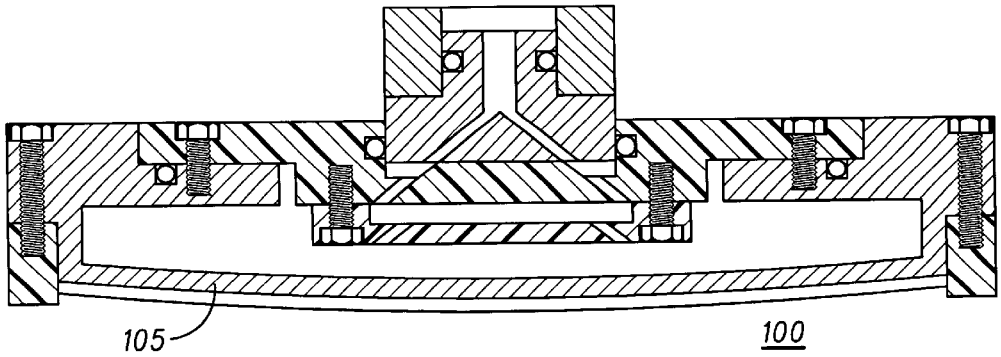
FIG. 5 is an illustration of the wafer carrier of FIG. 1 having the flexible wafer support structure in a bowed outward state.

FIG. 5 is an illustration of the wafer carrier of FIG. 1 having flexible wafer support structure 105 in a bowed outward state.

Figure 6:
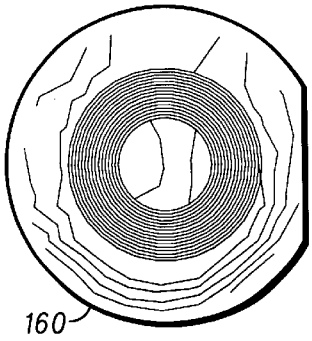
FIG. 6 is a topographic view of a semiconductor wafer polished using the wafer carrier of FIG. 1 in a bowed outward state.

FIG. 6 is a topographic view of a semiconductor wafer 160 polished using wafer carrier 100 of FIG. 1 in a bowed outward state as illustrated in FIG. 5. The downward force applied to semiconductor wafer 160 to conform to the surface contour (convex) of wafer carrier 100 of FIG. 1 is 4.5 psi. A pressure within the sealed cavity of wafer carrier 100 of FIG. 1 during the chemical mechanical planarization process was set at 4 psi. The closely spaced lines towards the center of the semiconductor wafer indicate a higher rate of material removal at the center of semiconductor wafer 160 than at the edge, as would be expected with a convex surface contour for wafer carrier 100 of FIG: 1.

Figure 7:
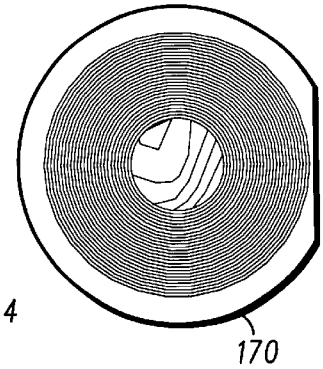
FIG. 7 is a topographic view of a semiconductor wafer polished using the wafer carrier of FIG. 1 under a pressure intermediate to the profiles used in FIG. 4 and FIG. 6.

FIG. 7 is a topographic view of a semiconductor wafer 170 polished using the wafer carrier 100 of FIG. 1 under a pressure intermediate to the pressures used in FIG. 4 and FIG. 6. The downward force applied to semiconductor wafer 170 to conform to the surface contour of wafer carrier 100 of FIG. 1 is 4.5 psi. A pressure within the sealed cavity of wafer carrier 100 of FIG. 1 during the chemical mechanical planarization process is set at 2 psi. The closely spaced lines are distributed somewhat evenly across semiconductor wafer 170 radius as would be expected with a setting between the pressure settings used in FIGS. 4 and 6.

Figure 8:
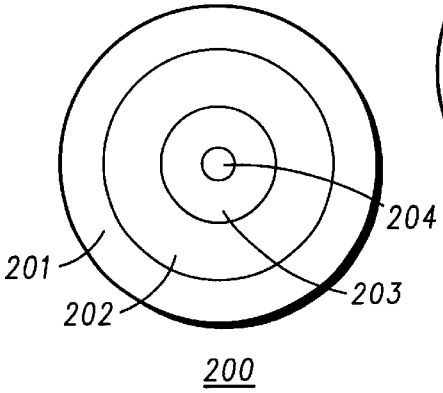
FIG. 8 is a view of the surface of a flexible wafer support structure made of different materials.

FIG. 8 is a view of the surface of a flexible wafer support structure 200 made of different materials that could be used in place of flexible wafer support structure 105 shown in FIG. 1. Flexible wafer support structure 200 comprises a first material ring 201, a second material ring 202, a third material ring 203, and a center material 204. In one embodiment of this technique, different materials would be used over different ranges of the radius of flexible wafer support structure 105. First material ring 201 is connected to second material ring 202, second material ring 202 is connected to third material ring 203, and third material ring is connected to center material 204. Utilizing different materials having varying thicknesses in the construction of flexible wafer support structure 200 is desirable for further increasing the planarity of the semiconductor wafer during the material removal process. The material rings are connected together using an e-beam welder or other equivalent fastening method. Each material ring has a different degree of strain for a given pressure or vacuum that is applied to flexible wafer support structure 200. The materials are specifically selected to counter or provide the varying material removal rates identified by modeling the CMP process being used.

Figure 9:
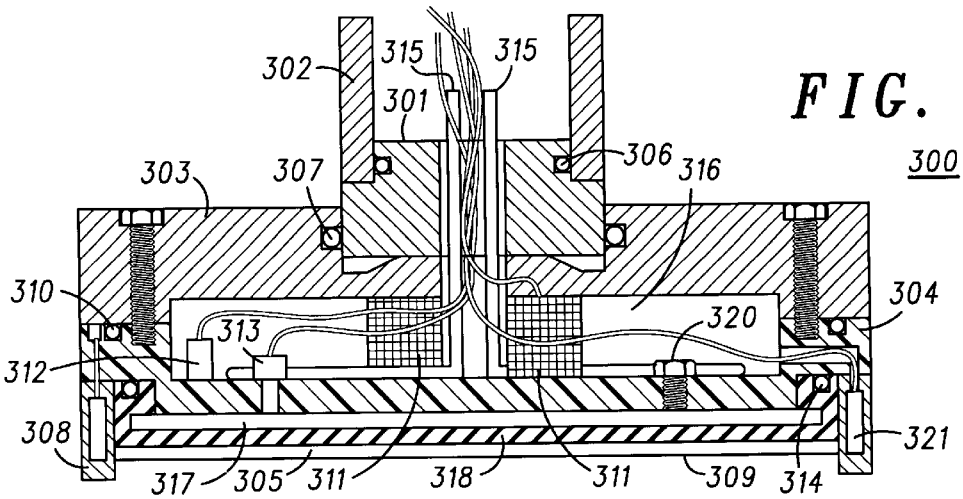
FIG. 9 is a cross-sectional view of a wafer carrier in accordance with the present invention.

FIG. 9 is a cross-sectional view of a wafer carrier 300 in accordance with the preferred embodiment of the present invention. Wafer carrier 300 is used in a CMP process to selectively remove material from a semiconductor wafer. In other words, wafer carrier 300 can remove material at different rates across the semiconductor wafer surface. The varying rate of material removal is achieved by changing a contour of a wafer support surface of wafer carrier 300. Furthermore, wafer carrier 300 is capable of insitu (selective) changes in the contour of the support structure during a material removal process, which can range from edge fast to a center fast material removal.

Wafer carrier 300 holds a semiconductor wafer without the need of vacuum during a transport process (pre/post material removal). Eliminating the need for vacuum greatly reduces the complexity of wafer carrier 300, although it should be noted that a vacuum hold system could be added to the structure. The contour of the wafer support surface of wafer carrier 300 is changed mechanically which allows precise control of the wafer support surface profile. The wafer support surface of wafer carrier 300 is rigid in comparison to a semiconductor wafer. A semiconductor wafer will conform to the contour of the wafer support surface when a down force used in the CMP process is applied to wafer carrier 300.

Wafer carrier 300 includes a carrier button 301, a drive shaft 302, a carrier cover 303, a pressure transfer plate 304, an elastically flexed wafer support structure 305, an o-ring 306, an o-ring 307, a carrier ring 308, a carrier film 309, an o-ring 310, a magnetostrictive actuator 311, a temperature sensor 312, a pressure transducer 313, an o-ring 314, and hydraulic fluid supply lines 315, a cavity 316, a cavity 317, an elastically flexed wafer support structure 318, a seal screw 320, and shape memory alloy 321. Similar to the description in FIG. 1, carrier button 301 and carrier cover 303 combine to provide angular compliance to wafer carrier 300. This invention is not limited to this configuration and other methods could be employed to achieve angular compliance.

A shaft of carrier button 301 fits into the hollow of drive shaft 302. The shaft of carrier button 301 is grooved to receive o-ring 306. O-ring 306 provides a pressure seal between the inner wall of drive shaft 302 and carrier button 301. A passageway is formed through carrier button 301 to route wires and hydraulic fluid supply lines 315 to cavity 316 within wafer carrier 300. Carrier cover 303 is a cover plate that includes an opening for receiving carrier button 301 and a flat contact surface that contacts the curved dome (a curved surface) of carrier button 301. The wall of the opening in carrier cover 303 is grooved for receiving o-ring 307 that forms a pressure seal between carrier button 301 and carrier cover 303 while allowing carrier button 301 to move in relation to carrier cover 303 as required to provide angular compensation.

Pressure transfer plate 304 is the bottom half of a sealed housing for wafer carrier 300. When pressure transfer plate 304 and carrier cover 303 are connected together, cavity 316 is formed therebetween. Magnetostrictive actuator 311, temperature sensor 312, a portion of hydraulic fluid supply lines 315, pressure transducer 313, and seal screw 320 reside within cavity 316. Pressure transfer plate 304 comprises an upper support structure, a sidewall, and a flexible plate. A groove is formed in the upper support structure of pressure transfer plate 304 for receiving o-ring 310. Carrier cover 303 is bolted to the upper support structure of pressure transfer plate 304. O-ring 310 provides a pressure seal between carrier cover 303 and pressure transfer plate 304.

Magnetostrictive actuator 311 is connected to either carrier cover 303 or pressure transfer plate 304. Carrier cover 303 is rigid and not affected by magnetostrictive actuator 311 while pressure transfer plate 304 is designed to be flexible. Bolts attach magnetostrictive actuator 311 to either carrier cover 303 or pressure transfer plate 304. Magnetostrictive actuator 311 changes the contour of pressure transfer plate 304 by expanding or contracting vertically. Magnetostrictive actuator 311 moves pressure transfer plate 304 outward or inward by respectively expanding or contracting. The magnitude of a current supplied to magnetostrictive actuator 311 determines whether pressure transfer plate 304 expands or contracts and by how much.

Magnetostriction is a physical property of a certain class of magnetic materials such as, for example, nickel that produces a change in shape when exposed to a magnetic field. Many materials capable of magnetostriction show this property at extremely low temperatures or have limited strains (small movement). Materials comprising rare earth metals such as terbium and dysprosium have extremely high magnetostrictive strains under low magnetic fields. Adding iron (Fe) to the rare earth metals moved the operating range for magnetostriction into a useful temperature range centered near room temperature (25 degrees centigrade). Typically, a coil (not shown) is used to change the magnetic bias on a magnetostrictive element. The current applied to the coil corresponds to the strength of the magnetic field. Magnetostrictive actuator 311 has properties that enhance the performance of wafer carrier 300. For example, magnetostrictive actuator 311 has a small size, operates with low power, does not age, has a linear response, repeats physical changes exactly, has a large range of motion, and has a hi-load range.

Elastically flexed wafer support structure 318 comprises an upper support structure, a sidewall, and a flexible plate. Cavity 317 is formed when pressure transfer plate 304 is connected to elastically flexed wafer support structure 318. The upper support structure of elastically flexed wafer support structure 318 is grooved for receiving o-ring 314. Pressure transfer plate 304 and elastically flexed wafer support structure 318 are held together by bolts. O-ring 314 provides a pressure seal between pressure transfer plate 304 and elastically flexed wafer support structure 318.

Cavity 317 is filled with a fluid through an opening in pressure transfer plate 304. In general, cavity 317 is filled with a fluid having a desirable heat capacity that is thermally conductive, non-corrosive and thermally-stable. Cavity 317 is filled with fluid during assembly and the opening is sealed by seal screw 320. Magnetostrictive actuator 311 makes contact with the central region of pressure transfer plate 304 and applies a force that is concentrated to this central region. The fluid in cavity 317 acts to distribute the force concentrated in the central region of pressure transfer plate 304 across the surface (interior to cavity 317) of elastically flexed wafer support structure 318. In other words, the fluid in cavity 317 acts as a force spreader or force distributor. The fluid distributes the force equally because it is desired for the external surface of elastically flexed wafer support structure 318 to have a programmable contour. The fluid acts to produce a contour in elastically flexed wafer support structure 318 that has no substantial discontinuities that could occur by providing a deformation force within a single region directly against the wafer support structure.

A second opening is formed in pressure transfer plate 304. Pressure transducer 313 is attached to pressure transfer plate 304 in the second opening to provide an active means of monitoring the pressure of the fluid in cavity 317. The measured pressure directly relates to the contour of the external surface of elastically flexed wafer support structure 318. Monitoring the pressure of the fluid provides continuous feedback that is used to accurately control the contour of the external surface of elastically flexed wafer support structure 318. Moreover, it is an added control factor for providing insitu changes in the contour of the external surface of elastically flexed wafer support structure 318 during a CMP process.

Fluid supply lines 315 provide a heated or cooled fluid for controlling the temperature of wafer carrier 300 and the semiconductor wafer being planarized. A portion of fluid supply lines 315 are placed in contact with the surface of pressure transfer plate 304 within cavity 316. Pressure transfer plate 304, the fluid in cavity 317, and elastically flexed wafer support structure 318 are heat conductive. The temperature of the heated or cooled fluid in fluid supply lines 315 is transferred to pressure transfer plate 304, the fluid in cavity 317, and elastically flexed wafer support structure 318, and together they act as a thermal mass for temperature control of the CMP process.

Carrier film 309 is placed on the external surface of elastically flexed-wafer support structure 318. Carrier film 309 is a compliant film that aids in holding the semiconductor wafer in place during the CMP process. Carrier ring 308 works in conjunction with carrier film 309 to hold the semiconductor wafer being polished. Carrier ring 308 is placed around elastically flexed wafer support structure 318 and carrier film 309. Bolts are used to hold carrier ring 308 to pressure transfer plate 304. A lip of carrier ring 308 extends beyond the exposed surface of carrier film 309. Carrier ring 308 includes shape memory alloy 321 and a covering material. A current applied to shape memory alloy 321 changes the diameter of carrier ring 308. The cover material of carrier ring 308 protects shape memory alloy 321 from the corrosive polishing environment and provides a surface suitable for making contact to the edge of the semiconductor wafer. For example, shape memory alloy 321 is encased in a polymer such as polyphenylene sulfide. Wires for providing electrical current to the memory shape alloy are connected through openings in pressure transfer plate 304, cavity 316, carrier cover 303, carrier button 301, and drive shaft 302.

Shape memory alloy 321 is constructed from a class of materials such as, for example, an alloy that includes nickel and titanium, that change phase from martensite to austenite when heated. Moreover, the rate of contraction is hundreds or thousands of times as large.as most thermally expandable materials. The constriction is due to a change in crystal structure of the material during heating. The change in crystal structure for a nickel-titanium alloy is a martensitic transformation. The material is more readily deformable in a martensite crystal form. Changing the shape memory alloy to an austenite crystal form produces a high strength material. The temperature at which the crystal transformation occurs can be accurately controlled by the composition of the shape memory alloy. The maximum force exerted by shape memory alloy 321 is controlled by the cross-sectional area of the alloy being used and the strength of the material in the austenite crystal form. Shape memory alloy 321 is heated through resistive heating and the amount of contraction is determined by the magnitude of the current supplied to shape memory alloy 321. The speed at which change occurs is a function of the time to heat and cool.

Prior art carrier rings also have a lip that extends beyond the exposed surface of the carrier film. During a polishing process centrifugal force can cause the semiconductor wafer to move from the wafer carrier. The lip of prior art carrier rings catches the edge of the semiconductor wafer to prevent it from leaving the wafer carrier. A design flaw of prior art carrier rings is that they are made to have an inner diameter greater than the diameter of a semiconductor wafer. The larger diameter is required for mechanical tolerances of the equipment to place the wafer within the wafer carrier prior to a transport process. Wafer damage could occur if the edge of a carrier ring were brought down on the semiconductor wafer. The larger diameter of the prior art carrier rings allows the wafer to move within the wafer carrier during the polishing process.

Under quiescent conditions carrier ring 308 has an inner diameter greater than the diameter of the semiconductor wafer (for ease-of-alignment purposes). However, the current applied to shape memory alloy 321 reduces the inner diameter of carrier ring 308 until full circumferential contact is made with the edge of the semiconductor wafer. The current applied to shape memory alloy 321 produces resistive heat which causes carrier ring 308 to constrict (inner diameter becomes smaller). The pressure placed on the semiconductor wafer by carrier ring 308 is directly proportional to the current. The pressure applied by carrier ring 308 is sufficient to hold the semiconductor wafer to wafer carrier 300 during transport and retain the semiconductor wafer (no movement) during the CMP process.

One scenario of how wafer carrier 300 is used on a CMP tool is described hereinbelow. Semiconductor wafers are typically planarized in a wafer lot of about 25 wafers. A translation mechanism on the CMP tool moves wafer carrier 300 in position to pick up a first semiconductor wafer from the wafer lot. Wafer carrier 300 is aligned and moved such that the semiconductor wafer is placed against carrier film 309. A current is supplied to shape memory alloy 321 of carrier ring 308 that constricts carrier ring 308 and holds the semiconductor wafer during a transport process.

An alternate approach to holding the semiconductor wafer without vacuum is to contract magnetostrictive actuator 311 while the semiconductor wafer is held flat against carrier film 309. Elastically flexed wafer support structure 318 is pulled inward, changing the surface from flat to somewhat concave or a bowed inward contour. The change in contour produces a partial vacuum that holds the semiconductor wafer to carrier film 309. Typically, the backside surface of the semiconductor wafer is wet which forms a seal that aids in holding the wafer to carrier film 309.

The temperature during a polishing process is another factor that affects the rate at which material is removed from a semiconductor wafer. The measured temperature of a semiconductor wafer during a material removal process varies from the first wafer to the last wafer of the wafer lot. Rates of chemical reaction have a direct relationship to the temperature of the chemicals. A problem has been identified where the first few wafers of a wafer lot remove material at a different rate than the other wafers of the wafer lot. Ideally, a constant temperature or repeatable temperature cycle is required during a material removal process for each semiconductor wafer to ensure consistent results over the entire wafer lot.

In this embodiment, fluid in fluid supply lines 315 heat wafer carrier 300 and the semiconductor wafer to a first temperature. Similarly, a platen of the CMP tool may also be brought to the first temperature to aid in controlling the rate of material removal during the CMP process. The first temperature can be made higher than ensuing temperatures used for other wafers of the wafer lot. The first temperature increases the rate of material removal to compensate for the lower rate of material seen in the first few wafers of a wafer lot. The actual temperature used, and how the temperature should be changed for each wafer of the wafer lot is determined by modeling and profiling the specific planarization process.

Continuing with the transport process, the exposed surface of the semiconductor wafer is brought down coplanar to a surface of a polishing media. Wafer carrier 300 is rotating as it is brought down. Similarly, the platen (support surface) is also rotating. A different current is applied to magnetostrictive actuator 311 to change the contour of elastically flexed wafer support structure 318. For example, the contour of elastically flexed wafer support structure 318 is changed to a convex or bowed outward contour to produce a center fast material removal pattern during the planarization process. A down force is applied to wafer carrier 300 that will conform the semiconductor wafer to the contour of elastically flexed wafer support structure 318 when it contacts the polishing media.

It may be required to reduce the pressure applied by carrier ring 308 to the edge of the semiconductor wafer as the planarization process begins. By conforming the shape of the semiconductor wafer to elastically flexed wafer support structure 318, there may be an undesired increase in the pressure at the edge of the semiconductor wafer. The diameter of carrier ring 308 is increased as the down force is applied to the semiconductor wafer. The increase in diameter prevents movement during a material removal process yet reduces the pressure applied to the edge of the wafer.

Planarization of the semiconductor wafer begins when the exposed surface of the wafer contacts the polishing media and polishing slurry. Material is removed abrasively and chemically. In general, a planarization or blanket material removal process is a timed event. The amount of material removed is controlled by the length of time the semiconductor wafer contacts the polishing media surface. Other factors such as temperature, down force on wafer carrier 300, or the speed of rotation of wafer carrier 300 and the platen play a significant role in the material removal rate. Wafer carrier 300 allows insitu changes in the surface contour during the material removal process. The semiconductor surface contour may be changed from a bowed outward contour (center fast material removal) to a bowed inward contour (edge fast material removal) as material is being removed. This ability will allow fine tuning of the CMP process to increase overall planarity across the wafer. As the CMP process is modeled and the mechanisms which govern the process are better understood, the planarization of all wafers in a wafer lot can be better controlled by utilizing wafer carrier 300.

As the planarization process moves towards completion, elastically flexed wafer support structure 318 is returned to its quiescent state, for example a flat or planar contour. A current is applied to carrier ring 308 to apply pressure to the edge of the semiconductor wafer to hold it to wafer carrier 300 during transport. The translation mechanism lifts wafer carrier 300 from the polishing media and transports the semiconductor wafer to an area of the CMP tool for cleaning the wafer. The semiconductor wafer is released from wafer carrier 300 by increasing the diameter of carrier ring 308 and putting elastically flexed wafer support structure 318 in a convex or bowed outward contour.

By now it should be appreciated that a wafer carrier for a CMP tool has been disclosed. The wafer carrier is capable of holding a semiconductor wafer without vacuum. The wafer carrier is heated and cooled to control the temperature of the wafer and chemical reaction rate of the polishing slurry. The wafer carrier can change the contour of the semiconductor wafer. Moreover, the contour can be changed to an infinite number of profiles during the planarization process. A sensor provides feedback to accurately control the status of the contour. Controlling the contour of the wafer carrier allows for the selective removal of material from a semiconductor wafer during a planarization process which results in better planarity across a wafer and more consistent planarity from wafer to wafer. Accommodations can be made via the shape of the carrier surface for wafers that have had thickness control problems in earlier steps of the semiconductor wafer manufacturing process.

What is claimed is:

1. A wafer carrier comprising a wafer support structure having a wafer support surface coupled to a cavity filled with a heated or chilled fluid wherein the wafer support surface is changeable from a quiescent surface contour to at least one other surface contour.

2. The wafer carrier of claim 1, wherein the at least one other surface contour of the wafer support structure is bowed outwards.

3. The wafer carrier of claim 1, wherein the at least one other surface contour of the wafer support structure is bowed inwards.

4. The wafer carrier of claim 1, wherein the wafer support structure, the fluid, and wafer support surface are heat conductive such that the temperature of the fluid controls the temperature of the wafer carrier.

5. The wafer carrier of claim 4, wherein pneumatic pressure changes a contour of the wafer support structure.

6. The wafer carrier of claim 4, wherein vacuum changes a contour of the wafer support structure.

7. A wafer carrier comprising a wafer support structure having a wafer support surface coupled to a fluid filled cavity wherein the wafer support surface is changeable from a quiescent surface contour to at least one other surface contour and including a mechanical actuator for changing a contour of the wafer support structure.

8. The wafer carrier of claim 7, wherein the fluid filled cavity coupled to the wafer support structure spreads a centrally concentrated force from the actuator to the wafer support surface.

9. A wafer carrier comprising a wafer support structure having a wafer support surface wherein the wafer support surface is changeable from a quiescent surface contour to at least one other surface contour and including a magnetostrictive actuator coupled to the wafer support structure for changing the wafer support contour between the quiescent surface contour and the other surface contour.

10. A wafer carrier comprising a wafer support structure having a wafer support surface wherein the wafer support surface is changeable from a quiescent surface contour to at least one other surface contour and further including a carrier ring coupled to the wafer support structure, a diameter of the carrier ring being adjustable to hold or retain a semiconductor wafer.

11. The wafer carrier of claim 10, wherein the carrier ring is made of more than one material.

12. A method of manufacturing integrated circuits comprising the steps of:

providing a semiconductor wafer;

coupling the semiconductor wafer to a surface of a wafer support structure;

changing a contour of the surface of the wafer support structure via a cavity filled with a heated or cooled fluid;

providing polishing slurry to a polishing media; and pressing an exposed surface of the semiconductor wafer against the polishing media wherein the semiconductor wafer conforms to the contour of the surface of the wafer support structure during a material removal process.

13. The method as recited in claim 12, further including changing the contour of the wafer support structure more than once during the material removal process.

14. The method as recited in claim 12, wherein the step of changing a contour of the surface of the wafer support structure further includes the steps of:

bowing outward the surface of the wafer support structure; and removing material of the semiconductor wafer center fast.

15. The method as recited in claim 12, wherein the step of changing a contour of the surface of the wafer support structure further includes the steps of:

bowing inward the surface of the wafer support structure; and removing material of the semiconductor wafer edge fast.

16. The method as recited in claim 12, wherein the step of changing a contour of the surface of the wafer support structure further includes a step of providing a pressure that varies across a radius of the semiconductor wafer to produce different rates of material removal across the radius of the semiconductor wafer.

17. A method of manufacturing integrated circuits comprising the steps of:

providing a semiconductor wafer;

coupling the semiconductor wafer to a surface of a wafer support structure;

changing a contour of the surface of the wafer support structure via a cavity filled with a heated or cooled fluid;

providing polishing slurry to a polishing media;

pressing an exposed surface of the semiconductor wafer against the polishing media wherein the semiconductor water conforms to the contour of the surface of the wafer support structure during a material removal process; and preventing lateral movement of the semiconductor wafer during the material removal process by constricting a diameter of a wafer carrier ring of the wafer support structure.

18. The method as recited in claim 12, further including a step of performing further wafer processing steps to complete the formation of integrated circuits on the semiconductor wafer.

19. A method of removing material from a semiconductor wafer comprising a step of varying pressure radially across the semiconductor wafer with a magnetostrictive actuator to promote different rates of material removal during a chemical mechanical planarization process.

20. The wafer carrier of claim 11, wherein the carrier ring comprises a shape memory alloy having an electrically alterable diameter.

21. The wafer carrier of claim 20, wherein the shape memory alloy comprises nickel and titanium.

22. The wafer carrier of claim 20, wherein the shape memory alloy constricts responsive to electrically induced resistive heating.

23. The wafer carrier of claim 20, wherein the shape memory alloy is encased in a covering material comprising a polymer.

* * * * *